United States Patent [19]

Hager

[11] Patent Number: 4,528,923

[45] Date of Patent: Jul. 16, 1985

[54] SEWING MACHINE HAVING A SYSTEM FOR APPROACHING A PREDETERMINED END POINT OF A SEAM

[75] Inventor: Walter Hager, Kaiserslautern, Fed. Rep. of Germany

[73] Assignee: Pfaff Industriemaschinen GmbH, Fed. Rep. of Germany

[21] Appl. No.: 624,602

[22] Filed: Jun. 26, 1984

[30] Foreign Application Priority Data

Jul. 8, 1983 [DE] Fed. Rep. of Germany ..... 3324715

[51] Int. Cl.[3] ..... D05B 69/22; D05B 27/22

[52] U.S. Cl. ..... 112/275; 112/121.11; 112/315

[58] Field of Search ..... 112/275, 121.11, 121.12, 112/272, 277, 2, 262.1, 314, 315

[56] References Cited

U.S. PATENT DOCUMENTS 4,403,558 9/1983 Martell et al. ..... 112/121.11

4,491,080 1/1985 Hager ..... 112/275

*Primary Examiner*—Peter Nerbun

*Attorney, Agent, or Firm*—McGlew and Tuttle

[57] ABSTRACT

A sewing machine with at least one feed means, the feed amount of which is variable by means of a positioning device acting on at least one positioning gearing; with a system for approaching a predeterminable end point of a seam in spaced relation to the edge of a workpiece; with a sensor disposed before the needle which during passage of the edge triggers the process for the positioning of the needle in the end point; with a pulse generator coupled with the main shaft of the sewing machine for the delivery of counting pulses for a pulse counter and a microcomputer which interrupts the action of the feed means as a function of the pulses emanating from the sensor and from the pulse generator in the end point. For the exact control of the insertion of the needle into the predetermined end point, the microcomputer is connected with a displacement system for an abutment for the presettable limitation of the movement deflection of a follow-up element coupled with the positioning gearing and with a servo system moving the latter against the abutment. For feed reversal immediately after execution of the stitch formation in the end position, the follow-up element is coupled with the positioning gearing through a freewheel coupling. To prevent displacement of the abutment by reaction of the forces occurring when the stitch length is shortened, the displacement system is connected with the abutment through a self-locking gearing.

6 Claims, 3 Drawing Figures

SEWING MACHINE HAVING A SYSTEM FOR APPROACHING A PREDETERMINED END POINT OF A SEAM

FIELD AND BACKGROUND OF THE INVENTION

This invention relates in general to sewing machines and in particular to a new and useful sewing machine having means for effecting the sewing of material around a predetermined end point of a seam.

In U.S. (Ser. No. 449,830), now U.S. Pat. No. 4,491,080 the feed movement of the feeder is interrupted by the abrupt lowering thereof when the needle has reached the desired end point of the seam. By this arrangement a satisfactory sewing result is indeed obtained by formation of the last stitch in the predetermined exact end position, but it cannot be used in machines with needle transport.

SUMMARY OF THE INVENTION

The invention provides a system for approaching a predeterminable end point of a seam which is usable for all sewing machines operating with variable stitch length.

Now with the development according to the invention a further way is indicated for approaching the exact end position of the needle whereby in sewing machines with needle transport the approach of the exact end position is made possible for the first time.

Accordingly it is an object of the invention to provide an improved sewing machine which includes a positioning device connected with the feed mechanism which includes a positioning gearing and a follow-up element connected to the gearing with a sensor disposed before the needle for initiating the positioning of the needle in the end point when the edge of the material passes by and including a pulse generator connected to the drive means producing counting pulses which are delivered to a microcomputer which is connected to the feed means for terminating the action of the feed at an end point.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
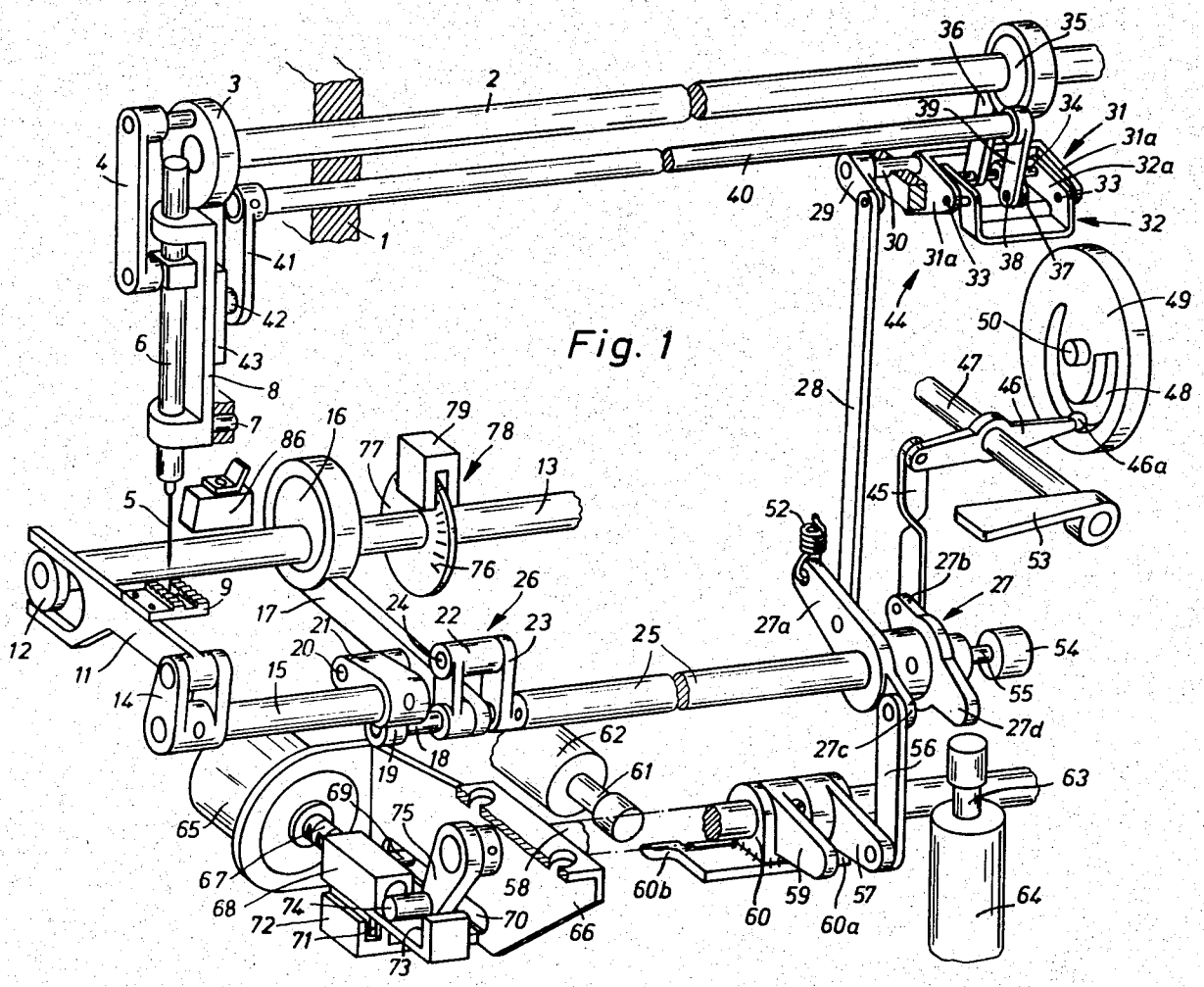
FIG. 1 is a perspective view of the drive mechanism of a sewing machine with bottom and needle transport.

Referring to the drawings in particular the invention embodied therein comprises a sewing machine generally designated 1 for effecting the sewing of a material around a predetermined end point of a seam.

As FIG. 1 shows, a main shaft 2, mounted in a housing 1 of a sewing machine, drives, via a crank 3 and a link 4, a needle bar 6 equipped with a needle 5. The needle bar is mounted in a rocker 8 oscillating about a pivot 7.

Figure 3:
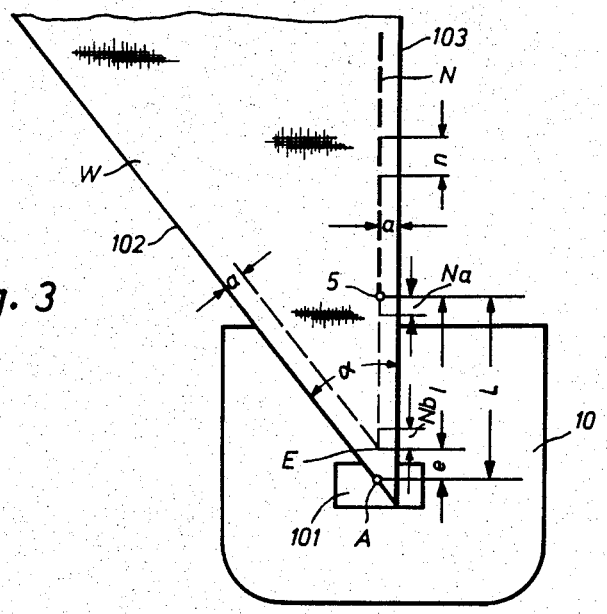
FIG. 3 is a schematic plan view of a corner sewing operation.

Cooperating with the needle 5 is a looper or shuttle (not shown) as well as a feeder 9, which is attached on a support 11 mounted below the stitch plate 10 shown in FIG. 3. By a fork type end the support engages around an eccentric 12, which is attached on a shaft 13 rotating synchronously with the main shaft 2. With every stitch forming process the eccentric 12 imparts a stroke movement to the feeder 9.

The support 11 is connected with a fork-shaped crank 14, which is attached on a swinging shaft 15 mounted in housing 1. For driving the swinging shaft 15, an eccentric 16 is fastened on shaft 13 whose eccentric rod 17 is articulated to a journal 18. Mounted on the journal 18 is a link 19, which by means of a journal 20 is connected with a crank 21 fastened on the swinging shaft 15. Laterally of the eccentric rod 17, on journal 18, a link 22 is fastened which engages around a journal 24 carried by a crank 23. The effective length of link 19 equals the effective length of link 22, so that, when the two journals 20 and 24 are aligned, the swinging shaft 15 remains at rest despite the eccentric rod 17 being in motion.

To vary the movement of eccentric rod 17 acting on the swinging shaft 15, crank 23 is clamped on a positioning shaft 25. The parts 15 to 25 form a positioning gearing 26 for the feed amount and direction of the feeder 9. The positioning shaft 25 carries a multi-arm crank 27, one crank arm **27*a* of which is connected via a link 28 with a crank 29 which is fastened on a positioning shaft 30 mounted in the housing 1. The positioning shaft 30 carries a yoke 31, between whose arms 31*a* an additional yoke 32 is rotatably mounted by means of bolts 33. The arms 32*a* of yoke 32 are connected by a bolt 34, to which swinging movements about the bolts 33 are imparted by an eccentric 35 secured on the main shaft 2, via an eccentric rod 36. Arranged on bolt 34 is further a link 37 which by means of a bolt is articulated to a crank 39 which is attached to one end of a swinging shaft 40 extending parallel to the main shaft 2. With the other end of the swinging shaft 40 a crank 41 is connected which carries a journal 42 which is guided between two flanges 43 disposed on the back of rocker 8. The parts 30 to 40 form a positioning gear 44 for the feed amount and direction of the needle 5**.

A second crank arm **27*b* of crank 27 is connected via a tie rod 45 with one end of a rocking lever which is secured on a shaft 47 mounted in housing 1. The still free end of the rocking lever 46 has a spherical projection 46*a* which protrudes between side walls of a positioning groove 48 of a positioning device 49 which is rotatably arranged on an axle 50 fast to the housing. By rotating the positioning device 49, the amount of feed movement of the feeder 9 and of the needle 5 is determined, the groove 48 being given a spiral form in such a way that stitch lengths of for example, 1–6 mm can be adjusted at the feeder 9 and the needle 5**.

At the crank arm **27*a*, an extension spring 52 hooked by its other end to the housing 1 engages, bringing about that the projection 46*a*, extending into the positioning groove 48, of the rocking lever 46 is in permanent abutment on the outer one of the side walls of groove 48, of the rocking lever 46 is in permanent abutment on the outer one of the side walls of groove 48, and that the feeder 9 in conjunction with the needle 5 displaces the work in a forward direction. To reverse the feed direction, there is fastened on the end of shaft 47 protruding from the housing 1 a switch lever 53, by which the rocking lever 46 can be pivoted for abutment on the inner side wall of the positioning groove 48**.

In axial extension of the positioning shaft 25, on the housing 1, a potentiometer 54 is arranged, whose positioning member 55 is fastened in an axial bore of the positioning shaft 25.

A third crank arm 27*c* of crank 27 is connected via a link 56 with a lever arm 57 which is carried loosely by a shaft 58 mounted in housing 1. Next to lever arm 57 another lever arm 59 is fastened on shaft 58. Both lever arms 57 and 59 are engaged from below by the connecting cross-piece 60*a* of a yoke 60 loosely mounted on shaft 58. The cross-piece 60*a* is extended laterally by an arm 60*b* which cooperates with the piston rod 61 of a compressed air cylinder 62 fastened in suitable manner in the housing 1.

Cooperating with a fourth crank arm 27*d* of crank 27 is a piston rod 63 of a compressed air cylinder 64 fastened in the housing 1.

A step motor 65, which is connected via an angle plate 66 with the housing 1, comprises a drive shaft designed as a threaded spindle 67. On the latter a threaded socket 68 is screwed. A journal 69 fastened laterally in the threaded socket 68 extends into a longitudinal groove 70 in the angle plate 66, to prevent rotation of the threaded socket 68. The threaded socket 68 carries also a metal lug 71, which projects into a Hall generator 72 which is secured on the angle plate 66 and which serves as a slot initiator. Lastly the threaded socket 68 carries, spaced from its end, an abutment 73. A journal 75 fastened on shaft 58 extends into the space between the end of the threaded socket 68 and the abutment 73 connected therewith.

Shaft 13 carries a pulse disc 77 of a pulse generator 78 provided with a plurality of line marks 76. The pulse generator also comprises a light scanning device 79 responding to the line marks 76. The line marks 76 are provided only on a portion of the pulse disc 77, namely on that part which during the transport phase of the feeder 9 and of the needle 5 passes through the light scanner 79. In this way the pulse generator 78 delivers pulses to a microcomputer 81 (FIG. 2) via a line 80 only during the transport phase of the sewing machine. Naturally, also a pulse generator may be used which delivers pulses during the entire rotational movement of shaft 13, if steps have been taken to prevent the forwarding of pulses via line 80 to the microcomputer 81 during the non-transport phase of the sewing machine.

One input of microcomputer 81 is connected via a line 82 with the potentiometer 54, another via a line 83 with a schematically represented input unit 84, and lastly an additional input via a line 85 with a sensor 86.

One output of the microcomputer 81 is connected via a line 87 with a known control circuit (not shown) of the step motor 65, and a second output via a line 88 with the Hall generator 72. Two additional outputs of microcomputer 81 are connected via two amplifiers (not shown) and two lines 89 and 90 with the switching magnets of two 4/2-way valves 91 and 92. The multiple way valves 91 and 92 serve for the controlled pressurization of the compressed air cylinders 62 and 64, the compressed air source being marked 93. An additional output of microcomputer 81 is connected via a line 94 with a known control circuit (not shown) of a position motor 95, which is in drive connection with the shaft 13 via a belt drive 96.

Lastly, a counter 97 is connected via a line 98 to one input and via a line 99 to one output of the microcomputer 81. Via a line 100 connected to an additional output of microcomputer 81, the counter 97 is resettable to "0".

The microcomputer 81 processes the pulses received from the pulse generator 78 and from the sensor 86 in accordance with its present program in a manner known in itself. In addition, it takes up the values depending on the rotational position of the potentiometer 54, which simulate the particular set stitch length. Of course, the stitch length to be executed may be entered in the microcomputer 81 by hand via the input unit 84 rather than the potentiometer 54 in case of stitch length adjustments.

The sensor 86, consisting of a light emitter and light receiver, is attached to the housing 1 of the sewing machine at a distance L (FIG. 3) before the path of needle 5. The sensor 86 cooperates with a reflecting foil 101 glued onto the stitch plate 10 of the sewing machine. A light beam emanating from the light emitter of sensor 86 falls onto a scanning point A, and in the absence of a workpiece W it is reflected by foil 101 onto the receiver of sensor 86. As soon as in fabric transport an edge 102 of the workpiece W, e.g. of a collar, moves over the scanning point A, the workpiece W interrrupts the reflection of the light beam, and sensor 86 sends a switching pulse via line 85 (also see FIG. 2) to the microcomputer 81.

During the making of a seam consisting of stitches N at a distance a from the edge 103 of the workpiece W, the sensor 86 for example signals that the edge 102 of the workpiece has cleared the scanning point A on the stitch plate 10 of the sewing machine or respectively on the reflection foil 101 glued thereon, by sending a switching pulse to the microcomputer 81 via line 85. Via line 94 the microcomputer switches the position motor 95 to a predetermined low speed, at which the sewing machine can later, upon reaching a predetermined end point E, be stopped.

At the same time, the counter 97 set on "0" is connected by the microprocessor 81 via line 99 to line 80 of the pulse generator 78. With continued sewing, the pulses delivered by the pulse generator 78 cause a forward counting of counter 97 starting from "0".

The starting of counter 97 falls into the transport phase of the sewing machine because the edge 102 of the workpiece W passes through the scanning point A only in this phase. In FIG. 3, the position of needle 5 is shown at the time the counter 97 is turned on. The counter 97 now counts the pulses delivered by the pulse generator 78 from delivery of the switching pulses of sensor 86 to completion of the stitch just then begun, during the residual stitch Na, and it sends this pulse number i at the end of this residual stitch to the microcomputer 81. The latter immediately thereafter calculates from the distance L and from the set stitch length n the number of full stitches N still to be executed after the residual stitch length Na, and the residual stitch length Nb to the end point E.

This computation depends on the distance L between the needle 5 (FIG. 3) and the scanning point A of sensor 86, on the distance e in the straight prolongation of the seam to be sewn between end point E and edge 102 of the workpiece W, on the set stitch length n, and lastly on the given pulse number i during execution of the residual stitch lengh Na of the stitch N being executed as the sensor 86 responds. The distance L is constant. The residual seam length 1 is the distance of needle 5 from the predetermined end point E. The pulse number i is dependent on the pulse generator 78 used. The distance e is dependent on the edge distance a of the seam from the edge 102 or 103 and on the edge angle of the corner of the workpiece W.

Figure 2:
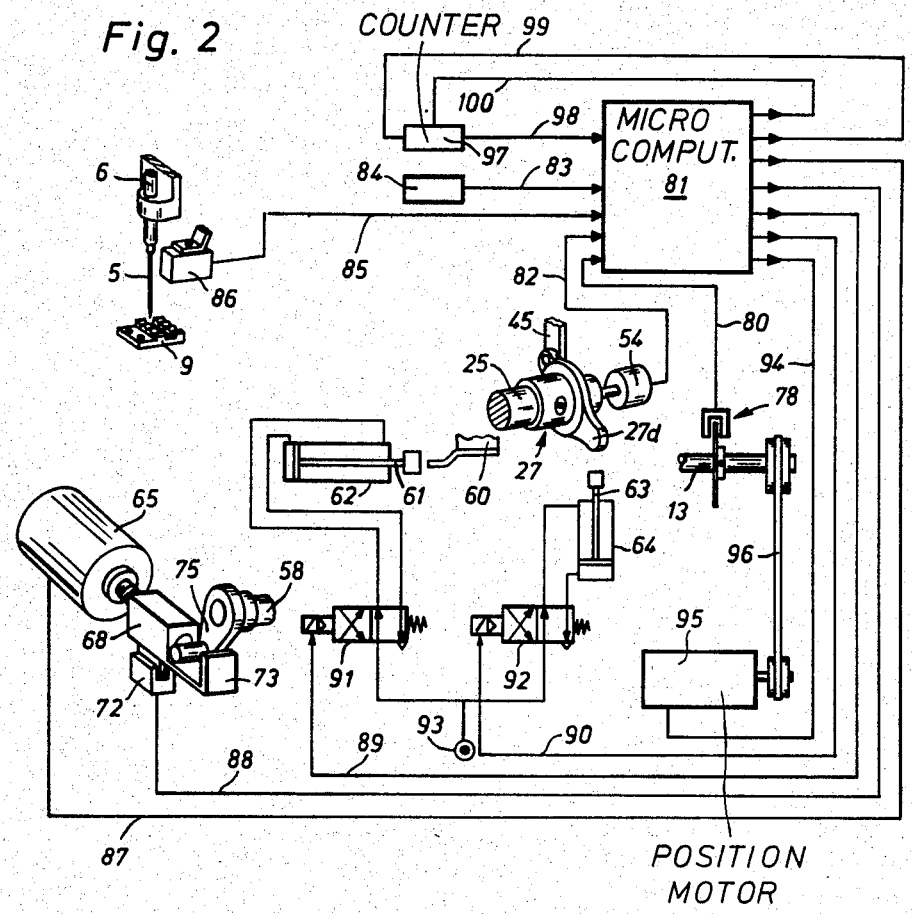
FIG. 2 is a schematic view of the connection of various parts of the control necessary for approaching the predetermined end point of a seam.

When setting the desired stitch length n by means of the setting device 49 (FIG. 1), the positioning shaft 25 is rotated via the rocking lever 46, the tie rod 45, and the crank 27. In so doing, the resistance of the potentiometer 54 connected with the positioning shaft 25 changes accordingly. This value is fed to the microcomputer 81 via line 82 (FIG. 2).

After calculation of the residual stitch length Nb to the end point E, the microcomputer 81 adjusts the step motor 65 during the stitch formation of the following stitches N via line 88, causing the threaded socket 68 to screw onto the threaded spindle 67 and to shift the abutment 73 into a position corresponding to the calculated residual stitch length Nb.

After execution of the number of complete stitches N calculated by the microcomputer 81, the microcomputer 81 (FIG. 2) causes connection of the compressed air cylinder 62 via the multiple-way valve 91 before the execution of the residual stitch length Nb, during the time in which no relative movement takes place between workpiece W and needle 5. Piston 61 of cylinder 62 (FIG. 1) pivots the yoke 60 over the arm **60*b* and pushes the two lever arms 57 and 59 upward until the crank 75, firmly connected with lever arm 59 via shaft 58, strikes with its journal 74 against the abutment 73 and thus terminates the pivotal movement of yoke 60. Via link 56 and crank 27, lever arm 57 taken along by yoke 60 rotates the positioning shaft 25 into the position corresponding to the residual stitch length Nb still to be executed. Also the positioning shaft 30 is brought into a corresponding rotational position via link 28. Due to the prior setting of the stitch length limitation by abutment 73 during the execution of the last stitches N, it is possible, within the short available time during the standstill phase between needle 5 and workpiece W before the end point E, to adjust the stitch-setting gearings 26 and 44 for the feeder 9 and for the needle 5, despite their rather high inertia, to the exact residual stitch length Nb determined by the microcomputer 81**.

Simultaneously with the turning on of the compressed air cylinder 62 (FIG. 2), the microprocessor 81 gives via line 94 a disconnect command for the position motor 95, which then brings about the stopping of the sewing machine in the down position of needle 5, in a manner known in itself. Thereby the feed movement of the last stitch N is terminated directly in the predetermined end point E (FIG. 3), the sewing machine stopping with needle 5 in the low position to permit subsequent rotation of the workpiece W. In this way the seam ends exactly in the predetermined end point E.

While the workpiece W is being turned, the microcomputer 81 through the step motor 65 resets the abutment 73 into its starting position, in which the Hall generator 72 sends via line 88 a turn-off pulse to the microcomputer 81.

But if instead of a rotary movement there is to occur from end point E of the seam an immediate locking in reverse sewing direction without stoppage of the sewing machine, then the stitch setting gearings 26 and 44 must be switched to sewing in reverse immediately after the formation of the last stitch. To this end, the microcomputer 81 via line 90 switches the multiple way valve 92 into its other position, whereby the compressed air cylinder 64 is reversed and its piston rod 63 pushes the lever arm **27*d* up until the projection 46*a* of lever 46, connected with crank 27 via rod 45, strikes against the inner sidewall of the positioning groove 48. In so doing, the positioning shafts 25 and 30 are displaced into a position which actuates sewing in reverse. Due to the independent rotation of the lever arm 57 relative to the lever arm 59 firmly connected with shaft 58, this displacement can be carried out independently of how fast the step motor 65 can reset the abutment 73** into its starting position.

Differing from the solution described, the possibility exists to approach the predetermined end point E of the seam in a different manner. For example, the microcomputer 81 can, after response of sensor 86 in the scanning point A, perform the computation and mechanical execution of the displacement of abutment 73 during a period of time sufficient therefor, in which stitches N of the previous length are executed. After response of the compressed air cylinder 62 in the standstill phase, following said period of time, between needle 5 and workpiece W, uniformly shortened stitches can then be executed with appropriate programming of the microcomputer 81, to the end point E, if the abutment 73 had been shifted into a corresponding position.

While specific embodiments of the invention have been shown and described in detail to illustrate the application of the principles of the invention, it will be understood that the invention may be embodied otherwise without departing from such principles.

What is claimed is:

1. A sewing machine for effecting the sewing of material around a predetermined end point of a seam, comprising a reciprocating needle, drive means for driving said needle, a feed mechanism connected to said drive means for feeding material into association with said needle and past said needle, a positioning device connected to said mechanism including a positioning gearing and a follow-up element connected to said gearing, a sensor disposed before said needle for initiating the positioning of said needle in the end point when an edge of the material passes by said sensor, a pulse generator connected to said drive means producing counting pulses, a microcomputer connected to said pulse generator, to said positioning gearing and to said feed means for terminating the action of said feed means in the end point in accordance with the pulses sensed by said sensor and adjusting means connected to said microcomputer and to said positioning gearing for presetting the limitation of movement of said follow-up element.

2. A sewing machine according to claim 1, wherein said positioning gearing includes a setting means including a step motor having a rotatable threaded spindle, an abutment alongside an end of said spindle, a socket engaged on said spindle and being movable thereby, said follow-up element including a crank member connected to said positioning gearing and being in the path of movement of said socket so as to be moved thereby toward said abutment.

3. A sewing machine according to claim 1, wherein said follow-up element is coupled with said positioning gearing by a free wheel coupling.

4. A sewing machine according to claim 3, wherein said gearing includes a shaft having two lever arms, one of which is connected to said shaft and the other of which fits around said shaft loosely and including a yoke surrounding said lever arms and a servo system including a compressed air cylinder connected to said yoke for moving said yoke to take along said lever arms therewith.

5. A sewing machine according to claim 2, including a step motor and a self-locking gearing connected between said step motor and said abutment.

6. A sewing machine according to claim 5, wherein said adjusting means includes a step motor having a drive shaft connected with said abutment via a helical gearing.

* * * * *